US006907915B2

(12) United States Patent
Hohenbichler et al.

(10) Patent No.: US 6,907,915 B2
(45) Date of Patent: Jun. 21, 2005

(54) METHOD AND INSTALLATION FOR PRODUCING A METAL STRIP

(75) Inventors: Gerald Hohenbichler, Kronstorf (AT); Heinrich Pühringer, Traun (AT); Gerhard Finstermann, Linz (AT); Ernest Fuhrmann, Linz (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 0 days.

(21) Appl. No.: 10/297,649

(22) PCT Filed: May 11, 2001

(86) PCT No.: PCT/EP01/05394

§ 371 (c)(1),
(2), (4) Date: Dec. 5, 2002

(87) PCT Pub. No.: WO01/94049

PCT Pub. Date: Dec. 13, 2001

(65) Prior Publication Data

US 2003/0173054 A1 Sep. 18, 2003

(30) Foreign Application Priority Data

Jun. 5, 2000 (AT) ..... A 982/2000

(51) Int. Cl.[7] ..... B22D 11/00

(52) U.S. Cl. ..... 164/476; 164/477; 164/417; 164/428; 164/454; 164/441; 164/484

(58) Field of Search ..... 164/476, 477, 164/417, 428, 454, 441, 484

(56) References Cited

U.S. PATENT DOCUMENTS

| | | | | |
|---|---|---|---|---|
| 3,773,228 A | * | 11/1973 | Koch et al. | 222/607 |
| 4,842,042 A | * | 6/1989 | Bartlett et al. | 164/463 |
| 5,503,217 A | * | 4/1996 | Perry et al. | 164/477 |
| 5,904,204 A | * | 5/1999 | Teraoka et al. | 164/417 |

FOREIGN PATENT DOCUMENTS

| | | |
|---|---|---|
| EP | 0726112 | 8/1996 |
| EP | 0540610 | 10/1996 |
| EP | 0760397 | 3/1997 |

(Continued)

OTHER PUBLICATIONS

Austrian Office Action.

R. W. Simon, et al., "Entwicklungsstand des direkten Giessens von Band auf der industriellen Pilotanlage Myosotis", *Metallurgie*, Kombiniertes Giessen und Umformen, Stahl und Eisen, vol. 117, No. 5, May 20, 1997, pp. 75–79 & 141. (English language Summary is attached).

(Continued)

*Primary Examiner*—Kiley S. Stoner
*Assistant Examiner*—I.-H. Lin
(74) *Attorney, Agent, or Firm*—Ostrolenk, Faber, Gerb & Soffen, LLP

(57) ABSTRACT

The invention relates to a method and to an installation for producing a metal strip. The aim of the invention is to make sure that the metal strip formed in the casting installation passes through the first cooling and grain texturing phase substantially without being subjected to stress and without effects on the subsequent installations. To this end, the molten bath is fed to a two-roll casting device and a cast metal strip is formed in the casting gap between two casting rolls whose rotational axes lie in a horizontal plane (two-roll casting method), the thickness of the cast strip ranging between 1.0 to 20 mm, preferably between 1.5 to 12 mm. The cast metal strip that freely emerges downwards from the two-roll casting installation is directly deflected from the vertical casting direction to a substantially horizontal transport direction. The metal strip is taken up and conveyed in a controlled manner by means of a first drive roll stand that operates at a first transport speed. The metal strip is then stored for a short time in a strip accumulator, and is then taken up and conveyed by means of a second drive roll stand that operates at a second transport speed. In a final step, the metal strip is coiled up to a bundle under pretension.

42 Claims, 2 Drawing Sheets

U.S. PATENT DOCUMENTS

| | | | |
|---|---|---|---|
| EP | 0776984 | | 6/1997 |
| JP | 56-119607 | | 9/1981 |
| JP | 63-49350 | | 3/1988 |
| JP | 8-090181 | | 4/1996 |
| JP | 9-239498 | | 9/1997 |
| WO | 92/01524 | | 2/1992 |
| WO | 9201524 | | 2/1992 |
| WO | 95/13156 | | 5/1995 |
| WO | 9948636 | * | 9/1999 |
| WO | 99/48636 | | 9/1999 |

OTHER PUBLICATIONS

R. Stein–Versen, "Die Versuchsanlage zum Duennbandgiessen der Krupp Stahl AG im Werk Unna der VDM Nickel–Technologie", *Metallurgie*, Stahl und Eisen, vol. 110, No. 7, Jul. 13, 1990, pp. 117–118.

* cited by examiner

Fig. 1
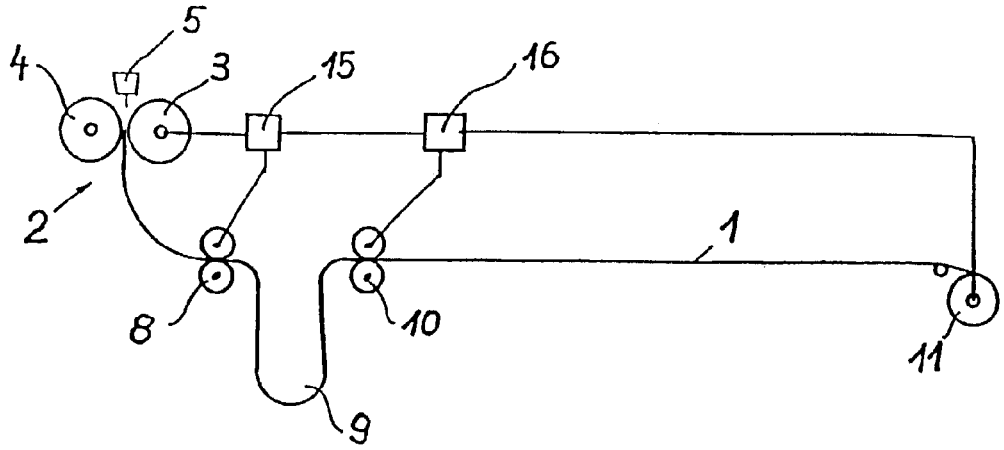
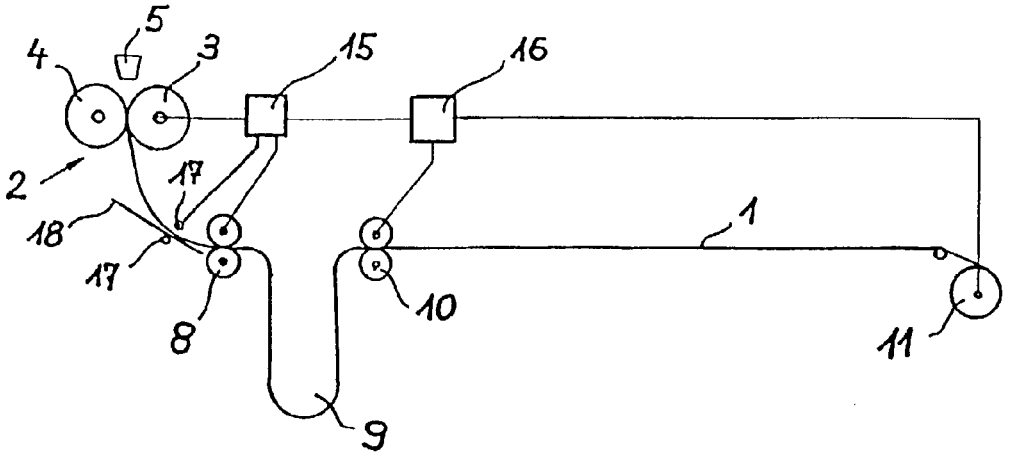
Fig. 2

METHOD AND INSTALLATION FOR PRODUCING A METAL STRIP

CROSS REFERENCE TO RELATED APPLICATIONS

This is a continuation of International Application No. PCT/EP01/05394, filed May 11, 2001, published in the German language at A400685WO, and which claims priority from Austrian application No. A 982/2000, filed Jun. 5, 2000.

BACKGROUND OF THE INVENTION

1. Field of the Invention

The invention relates to a method and a plant for the production of a metal strip, preferably a steel strip, in particular consisting of stainless steel and carbon steel, with a casting thickness of 1.0 mm to max. 20 mm, preferably 1.5 mm to max. 12 mm, and with excellent surface quality, using the two-roll casting method and further treatment stages.

2. Description of the Related Art

EP-A 776 984 already discloses a plant of this type for the production of a metal strip according to the two-roll casting method. This two-roll casting device is followed by a hot-rolling stand, by means of which the cast strip is rolled to form an intermediate product of predetermined strip thickness. To ensure a uniform delivery of the cast metal strip to the rolling stand, the latter is preceded by a driving-roller stand. A substantial disadvantage of this plant arrangement is that the casting speed in the two-roll casting device and the rolling speed in the rolling stand have to be constantly co-ordinated with one another and even minor speed deviations in one of the plant components give rise to reactions on other plant components which are detrimental to the quality of the product produced. Identical problems with the synchronization of the casting speed and rolling speed also arise in a casting-roll plant, such as is described in EP-A 760 397 and illustrated in FIG. 3. The strip cast in a two-roll casting plant is conveyed by a driving-roller stand and, before it enters the rolling stand, is held under tension by a compensating roller.

It is already known from JP-A63-48350 to cast metal strips consisting of permalloy and aluminium with a thickness of up to 1.0 mm according to the two-roll casting method, to store briefly the metal strip in an intermediate store, in which the metal strip is tautly tensioned by a compensating roller, or, according to other embodiments, in an intermediate store formed by a loop pit which the metal strip runs through, hanging freely, and subsequently to deliver the said metal strip to a strip-winding device. As a result of the brief intermediate storage, the two-roll casting device is separated functionally from the winding plant to the extent such that jolt-like movements in the metal strip which emanate from the strip winder do not react into the region of the casting plant and the high-temperature zone of the metal strip and lead to damage there. By virtue of the brief intermediate storage, there is also no need for a synchronization of the casting speed and winding speed. Due to the long metal-strip loop which fluctuates in length and which extends, hanging down freely under its own weight, directly from the casting gap and, by being deflected, undergoes an undefined pendulum movement, sharply fluctuating tensile stresses for the metal strip arise, which lead to the formation of cracks and to damage to the strip surface. Where relatively large strip thicknesses are concerned, the risk of cracking rises in the immediate vicinity of the casting gap owing to the increasing dead weight. Even when the metal strip forms a strip loop in a loop pit only after being supported by some supporting rollers, adverse reactions of the loop movement on the stress conditions in the metal strip in the region near the casting gap occur. The same difficulties also arise when plants, such as are described in EP-B 540 610 (WO-A 92/01524), EP-A 726 122 or WO-A 95/13156, are used to produce a metal strip. In all instances, a strip loop sagging freely under its own weight is formed immediately downstream of the two-roll casting device.

It is known, furthermore, from JP-A 63-238 963, in a casting plant, the mould of which is formed by rotating bands, to cast a metal strip in a thickness range of 15 to 50 mm. The metal strip is conveyed further on, at a regulated speed, by a pair of driving rollers and is guided through a loop pit prior to thickness reduction in a multi-stand hot-rolling mill. The strip sag of variable length in the loop pit causes different strip-tension conditions upon entry into the hot-rolling mill, with the result that adherence to a uniform strip quality is not ensured. In addition, the strip runs out of true laterally in the rolling stand.

SUMMARY OF THE INVENTION

The object of the invention is, therefore, to avoid these disadvantages and to propose a method and a plant of the type described in the introduction, in which the metal strip formed in the casting plant runs, largely free of load and without reactions from following devices, through the first cooling and structure-forming phase. The object of the invention is, further, to keep the dead-weight load on the metal strip as constant as possible in this phase after the formation of the metal strip and nevertheless to make it possible to vary the transport speed in following devices. Further, an optimization of the production process in terms of the uniformly highest possible strip quality is to be achieved.

The production of a metal strip is carried out in a two-roll casting plant between two cooled casting rolls which rotate in opposite directions to one another and form in a casting direction, for the melt, a gradually narrowing reception space which is delimited by side plates on the end faces of the casting rolls. Via a distributor device, melt is introduced into this casting space, and, on the cooled outer surfaces of the casting rolls, billet shells are formed, which are connected at the narrowest point between the casting rolls to form a strip of predetermined thickness. The metal strip formed is reduced in thickness in a rolling device in further treatment stages or is delivered directly to a winding device and wound into coils.

This object is achieved, with regard to the method, by means of the following steps:

- delivery of metal melt to a two-roll casting device and formation of a cast metal strip in the casting gap between two casting rolls, the axes of rotation of which lie in a horizontal plane (two-roll casting method), with a thickness of the cast strip of 1.0 to 20 mm, preferably 1.5 to 12 mm,
- direct deflection of the cast metal strip emerging freely downwards from the two-roll casting device from the vertical casting direction into an essentially horizontal transport direction,
- reception and regulated transfer of the metal strip by means of a first driving-roller stand at a first transport speed,
- brief storage of the metal strip in a strip store,
- reception and transfer of the metal strip by means of a second driving-roller stand at a second transport speed,
- winding-up of the metal strip under tension into coils.

The reception and regulated transfer of the metal strip by means of a first driving-roller stand, the brief storage of the metal strip in a strip store and the reception and transfer of the metal strip by means of a second driving-roller stand take place in directly successive treatment steps.

The fixing of the strip position by means of the formation point of the metal strip in the casting gap of the two-roll casting device and of the first clamping in the first driving-roller stand makes it possible to determine an optimum corridor which corresponds essentially to a quarter arc, in which the metal strip is conveyed further on, largely free of load, specifically even when the transport speed of the metal strip in the first driving-roller stand is regulated as a function of the casting speed. The arrangement of a first driving-roller stand for the reception and regulated transfer of the metal strip prior to the brief storage of the latter as a freely hanging strip loop in a loop pit prevents reactions from the dead weight and loop movement on the awkward first cooling and structure-forming phase.

BRIEF DESCRIPTION OF THE DRAWINGS

The invention is described below by means of several exemplary embodiments which are illustrated in a diagrammatic illustration in the drawing.

FIG. 1 shows a plant in a first embodiment in a diagrammatical longitudinal section through the plant;

FIG. 2 shows a plant in a second embodiment in a diagrammatic longitudinal section through the plant.

DETAILED DESCRIPTION OF PREFERRED EMBODIMENTS OF THE INVENTION

Figure 3:
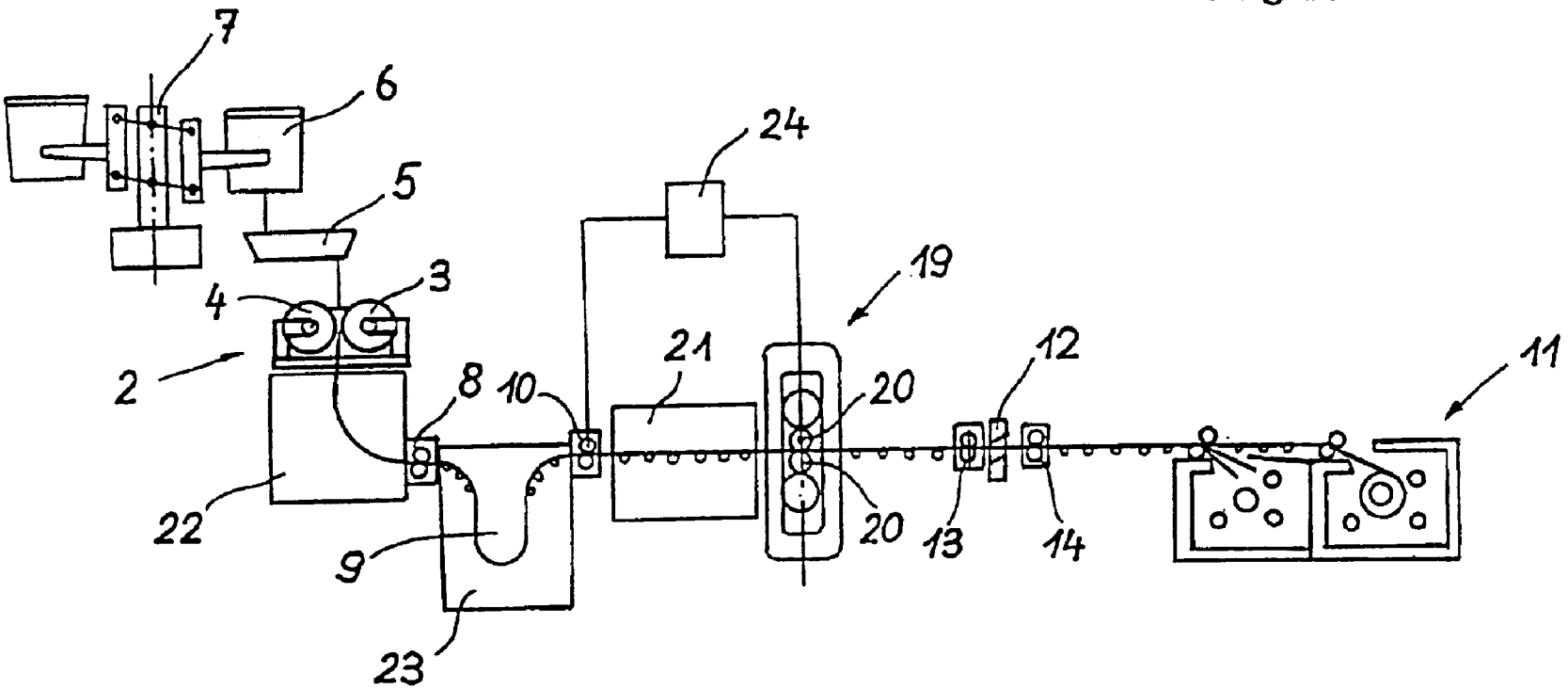
FIG. 3 shows a plant with an integrated rolling stand in a diagrammatic longitudinal section through the plant.

According to an advantageous refinement of the invention, the position of the metal strip in the region of deflection from the vertical direction into the horizontal direction, preferably the resting point of the metal strip on a deflecting support device, is detected by measurement by means of a strip location device and a strip transport speed in the first driving-roller stand and/or the casting speeds in the casting gap are regulated as a function of this. By virtue of a deflecting support device which is designed as an arcuate guide scaffold and is mounted pivotably in the plant supporting framework and extends only over a subsection of the path from the first driving-roller stand to the two-roll casting device, regulatability within a narrow, but sufficient range is maintained.

In so far as no further treatment steps on the metal strip which influence the strip speed are provided, the winding-up of the metal strip under tension can advantageously be regulated as a function of the transport speed of the metal strip in the first or in the second driving-roller stand, if appropriate with the casting speed being taken into account.

An important and known measure for producing a fine-grained crystal structure and for preinfluencing the physical properties of the metal strip and its surface quality takes place by means of roll-forming which is carried out in-line at the casting speed. It is already known from EP-B 540 610 (WO-A 92/01524) to provide a rolling stand downstream of a temperature-compensating zone, during roll-forming the metal strip being held under longitudinal tension between driving-roller stands directly preceding and following the rolling stand. It is further known, in a temperature control zone preceding the rolling stand and the directly preceding driving-roller stand, to carry out a setting of the metal-strip temperature in terms of the subsequent roll-forming. Similar solutions for in-line roll-forming in conjunction with a two-roll casting plant are also described, for example, in JP-A 56-119607, WO-A 95/13156 and EP-A 760 397.

In a development of an optimized method sequence, it is advantageous if a reduction in thickness and an establishment of the structure of the metal strip take place by roll-forming in a rolling plant with a minimum degree of reduction of 20%, under strip tension, after the run through the second driving-roller stand, a final strip thickness of 0.5 to 10 mm, preferably of 0.7 to 6 mm being achieved.

It is expedient if the casting thickness and the final strip thickness are co-ordinated with one another in such a way that the thickness reduction takes place in a single rolling path.

At the commencement of the rolling process, improvements in the quality of the metal strip are obtained if the reduction in thickness of the metal strip takes place in the rolling plant by means of working rolls preheated to at least 10° C. above the hall temperature, preferably 20° C. above the hall temperature.

Favourable initial conditions in the metal strip can be established for the roll-forming of the respective steel qualities when, downstream of the second driving-roller stand and even before the reduction in thickness taking place, if appropriate, in the rolling plant, temperature compensation in the metal strip, but at least a balancing of the temperature of the strip edges with the prevailing temperature takes place in a temperature-setting zone. In general, however, both a raising and a lowering of the strip temperature to the optimum rolling temperature are provided. The metal strip is expediently held under strip tension in the temperature-setting zone by means of the second driving-roller stand.

As a function of specific steel qualities, it is expedient if the metal strip runs, between the two-roll casting device and the first driving-roller stand, through an inertization chamber with an atmosphere preventing or at least inhibiting the oxidation of the metal strip, in that suitable fluids (gas mixtures or else liquid mixtures) are introduced or are brought into direct contact with the hot metal strip. This counteracts the general tendency of steels to reoxidation at high temperatures. The same effect arises when the metal strip is maintained under a non-oxidizing atmosphere in the region of the strip store.

After the various steps of the method, before being wound up the metal strip is divided according to predetermined coil weights and, if appropriate, the strip edges are trimmed.

A plant for the production of a metal strip, preferably a steel strip, which complies with the set object, is formed by the following devices:

- a two-roll casting device with two casting rolls which form a casting gap and the axes of rotation of which lie in a horizontal plane,
- a first driving-roller stand for the reception and regulated transfer of the cast metal-strip,
- a strip store, preferably designed as a loop pit, for the brief storage of the metal strip,
- a second driving-roller stand for the reception and transfer of the metal strip,
- a strip-winding device for the regulated winding-up of the metal strip under tension.

In this case, the first driving-roller stand directly precedes the strip store and the second driving-roller stand directly follows the strip store. According to an advantageous refinement, the two driving-roller stands are positioned as entry-side and exit-side deflecting rollers at the strip store.

Preferably, for the deflection of the cast metal strip from the vertical casting direction into an essentially horizontal transport direction, a corridor which is formed by a quarter arc and, at least in a part-region is formed by a deflecting support device is provided between the two-roll casting device and the following first driving-roller stand.

Favourable operating conditions for the plant, particularly in the portion, sensitive for the metal strip, between the two-roll casting plant and the first driving-roller stand, arise when a rotary drive of the casting rolls and a rotary drive of the first driving-roller stand are connected to a regulating device for regulating the transport speed of the metal strip in the first driving-roller stand. An advantageous structural refinement is obtained when a deflecting support device for deflecting the cast metal strip out of a vertical casting direction into an essentially horizontal transport direction is arranged between the two-roll casting device and the following first driving-roller stand. The deflecting support device is designed as an arcuate guide scaffold which extends from the first driving-roller stand over at least a subsection of the path to the two-roll casting device and is preferably articulated pivotably in the plant supporting framework.

Favourable operating conditions arise, according to a further embodiment, when a strip location device is arranged between the two-roll casting device and the first driving-roller stand, the said strip location device being coupled in regulation terms to the first driving-roller stand, if appropriate also to the two-roll casting device, via a regulating device. Consequently, the external conditions for the metal strip in its first cooling and structure-forming phase can be kept essentially constant. A deflecting support device of this type, with a strip location system, is described in detail in WO-A 99/48636. The entire disclosure content of WO-A 99/48636 is to be considered as an integral part of this application.

For thickness reduction and for establishing a rolled structure in the metal strip, a rolling plant for thickness reduction and structural transformation on the cast metal strip is arranged downstream of the second driving-roller stand. The rolling plant is advantageously formed by a single rolling stand, preferably a four-high rolling stand.

To improve the rolling conditions and the commencement of rolling, the working rolls of the rolling plant are assigned heating devices, preferably an induction-heating device or gas burner capable of being advanced to the working rolls.

Downstream of the second driving-roller stand, the rolling plant is preceded by a temperature-setting device, in particular strip heating for the rise in strip temperature, preferably strip-edge heating. A drive motor of the second driving-roller stand is coupled to the drive of the rolling plant by means of a regulating device in such a way that the metal strip is held under tension in the temperature-setting device and/or in the rolling plant.

In order to prevent reoxidation effects on the hot metal strip, the metal strip runs through an oxidation-preventing or at least oxidation-inhibiting inertization chamber arranged between the two-roll casting device and the first driving-roller stand. The strip store between the first driving-roller stand and the second driving-roller stand is likewise designed as an inertization chamber. The inertization chambers may at the same time also be used as temperature-compensating zones and have corresponding devices for cooling or heating the inert gas.

Further, the rolling plant is followed by a strip-cooling section for the controlled cooling of the metal strip. This is followed by a cross-dividing device and, if appropriate, a strip-trimming device which precede the strip-winding device, and at least upstream and downstream of the cross-dividing device are arranged driving-roller stands which keep the rolled strip under tension during cutting.

To maintain a continuous casting operation, a tundish for melt transfer is arranged above the two-roll casting device and a casting ladle for melt preparation is arranged above the said tundish. The casting ladle is supported in an extension arm of a ladle turret which is supported so as to be pivotable about a vertical axis from a casting position into a ladle-changing position and back again.

In the following description, recurring devices are always designated by the same reference symbol in the various embodiments. FIG. 1 shows a plant according to the invention for the production of a metal strip 1 with a thickness of a few millimetres, starting from a two-roll casting device 2 which is indicated diagrammatically by the two casting rolls 3, 4. Melt which flows in from a casting ladle 6 is delivered to the two-roll casting device 2 via a tundish 5. FIG. 3 illustrates a ladle turret 7 which carries the casting ladles 6 and about the vertical axis of which it is supported rotatably. It consequently becomes possible to transport the casting ladles 6 from a casting position above the tundish 5 into an opposite ladle-changing position and therefore to have a sequential casting process. The metal strip 1 is formed in the two-roll casting plant 2 along the outer surfaces of the casting rolls 3, 4 and is conveyed out downwards as a result of the rotation of the latter. The metal strip is deflected in a quarter arc into the horizontal direction and there is picked up by a first driving-roller stand 8 and transferred directly into a strip store 9 designed as a loop pit. At the exit from the strip store 9, the metal strip is picked up by the second driving-roller stand 10 and delivered to a strip-winding device 11. The metal strip 1 is wound there into coils. A strip-trimming and cross-dividing device 12 preceding the coil-winding device 11 and having preceding and following driving-roller stands 13, 14 is illustrated only in FIG. 3.

A regulating device 15 connects a rotary drive of the casting rolls 3 to the rotary drive of the first driving-roller stand 8 and allows a largely constant strip guidance between the two-roll casting plant 2 and the first driving-roller stand 8. A second regulating device 16 regulates the winding speed and the transport speed in the second driving-roller stand 10 as a function of the transport speed in the first driving-roller stand 8 and/or of the casting speed.

FIG. 2 shows a further embodiment with an improved process management system. Between the two-roll casting plant 2 and the first driving-roller stand 8 is arranged a strip location system 17 which determines the instantaneous position of the metal strip 1 in this region. This may take place, for example, by means of optical, thermal, acoustic or mechanical measuring methods. In particular, a measuring device is to be selected which withstands relatively high thermal stress. The strip location system is connected in regulation terms to the regulating device 15. A deflecting support device 18, taking care of the surface of the metal strip, guides the latter to the first driving-roller stand 8.

FIG. 3 illustrates a plant incorporating a rolling plant for producing a rolled metal strip with an excellent rolled structure and outstanding surface quality, comparable to a conventional cold-rolled metal strip. The second driving-roller stand 10 is followed by a rolling plant 19 formed by an individual four-high stand. The working rolls 20 can be equipped with heating devices (not shown). The rolling plant 19 is directly preceded by a temperature-setting device 21 which directly follows the second driving-roller stand 10. The drive motor of the second driving-roller stand 10 is coupled to the drive of the rolling plant 19 by means of a regulating device 24 in such a way that the metal strip is held under tension in the temperature-setting device 21. Optimum temperature control in the rolling plant 19 is consequently ensured. An inertization chamber 22 is arranged between the two-roll casting plant 2 and the first driving roller stand 8 and a further inertization chamber 23 is arranged between the first driving-roller stand 8 and the second driving-roller stand 10. The strip store 9 forms at the same time the second inertization chamber 23. The reoxidation of the hot metal strip is thereby prevented.

What is claimed is:

1. A method for producing a hot-rolled metal strip, the method comprising:

delivering metal melt to a two-roll casting device;

forming a cast metal strip in a casting gap between two casting rolls of the casting device that rotate along a horizontal axis, and forming the cast metal strip with a thickness of 1 to 20 millimeters;

as the cast metal strip freely emerges from the two-roll casting device in a substantially vertical direction, directly deflecting the cast metal strip to travel in a substantially horizontal transport direction;

passing the cast metal strip through an inertization chamber located after the strip passes the two-roll casting device, wherein the inertization chamber has an atmosphere that prevents or inhibits oxidation;

receiving and regulating transfer of the cast metal strip at a first transport speed by means of a first driving-roller stand after the strip passes the inertization chamber;

temporarily storing the cast metal strip in a strip store after the strip passes the first driving roller-stand;

receiving and transferring the cast metal strip by means of a second driving-roller stand at a second transport speed after the strip passes the first driving-roller stand;

roll-forming the metal strip by a rolling plant under strip tension to reduce thickness of the metal strip after the strip passes the second driving roller stand; and then winding the metal strip under tension into coils to produce the hot-rolled metal strip.

2. The method of claim 1, wherein the cast metal strip is a steel strip.

3. The method of claim 1, wherein the cast metal strip is formed with a thickness of 1.5 to 12 millimeters.

4. The method of claim 1, wherein the step of directly deflecting the cast metal occurs within a corridor formed by a quarter arc.

5. The method of claim 1, wherein the first transport speed of the metal strip is regulated as a function of the speed of forming the cast metal strip.

6. The method of claim 1, further comprising:

detecting a position of the metal strip on a deflecting supporting device in the region of deflection from the substantially vertical direction to the substantially horizontal direction by means of a strip location device; and regulating at least one of the first transport speed and the speed of the strip of the cast metal strip in the casting gap as a function of the position detected the step of detecting.

7. The method of claim 6, wherein the position of the metal strip is a resting point of the metal strip on the deflecting support device.

8. The method of claim 1, further comprising regulating the step of winding as a function of the respective transport speed of the metal strip in at least one of the first driving-roller stand and the second driving-roller stand.

9. The method of claim 8, further comprising further regulating the step of winding as a function of speed of the cast metal strip being cast.

10. The method of claim 1, wherein the step of roll-forming the cast metal strip is performed to reduce the thickness of the cast metal strip by at least 20% and to establish a structure of the cast metal strip with a thickness of 0.5 to 10 millimeters.

11. The method of claim 10, wherein the step of roll-forming the cast metal strip is performed to establish a structure of the cast metal strip with a thickness of 0.7 to 6 millimeters.

12. The method of claim 10, wherein the step of roll-forming occurs in a single rolling pass.

13. The method of claim 10, further comprising preheating working rolls in the rolling plant to at least 10° C. above room temperature.

14. The method of claim 10, further comprising preheating working rolls for the cast metal strip, the working rolls being in the rolling plant to 20° C. above room temperature.

15. The method of claim 1, further comprising:

determining a prevailing temperature of the cast metal strip; and adjusting in a temperature-setting zone the temperature of edges of the metal strip to the prevailing temperature of the cast metal strip.

16. The method of claim 15, further comprising adjusting the temperature of the metal strip in the temperature setting zone subsequent to the step of receiving and transferring the cast metal strip by the second driving-roller stand and prior to the step of roll-forming the metal strip.

17. The method of claim 15, further comprising holding the metal strip under strip tension in the temperature-setting zone by means of the second driving-roller stand.

18. The method of claim 1, further comprising maintaining the metal strip under an oxidation-preventing or oxidation-inhibiting atmosphere in the region of the strip store.

19. The method of claim 1, further comprising temporarily storing the metal strip in the strip store as a freely hanging loop.

20. The method of claim 1, further comprising dividing the metal strip into predetermined coil weights prior to the step of winding.

21. The method of claim 20, further comprising trimming edges of the metal strip prior to the step of winding.

22. A plant for producing a hot-rolled cast metal strip, the plant comprising:

a two-roll casting device including two casting rolls defining a casting gap between them, and the two casting rolls rotate around a horizontal axis and produce a cast metal strip from metal passed through the casting gap;

a deflecting support device after the two-roll casting device and operable to deflect the cast metal strip from a substantially vertical casting direction to a substantially horizontal transport direction;

an inertization chamber also after the two-roll casting device and operable to allow the cast metal strip to pass through the inertization chamber, wherein the inertization chamber has an atmosphere that prevents or inhibits oxidation;

a first driving-roller stand operable to receive and regulate a transfer of the cast metal strip from the casting gap;

a strip store operable to temporarily store the cast metal strip after the first driving-roller stand;

a second driving-roller stand after the strip stand operable to receive and transfer the cast metal strip;

a rolling plant arranged after the second driving roller stand and operable to reduce a thickness of the cast metal strip; and a strip-winding device operable to regulate a winding of the metal strip under tension.

23. The plant of claim 22, wherein the cast metal strip is a steel strip.

24. The plant of claim 22, wherein the strip store is designed as a loop pit.

25. The plant of claim 22, further comprising a corridor formed by a quarter arc and at least in a part-region formed by the deflecting support device.

26. The plant of claim 25, wherein the deflecting support device comprises an arcuate guide scaffold which extends from the first driving-roller stand over at least a subsection of a path to the two-roll casting device, wherein the deflecting support device is operable to pivot within the plant.

27. The plant of claim 22, further comprising a casting rolls rotary drive (or rotating the casting rolls and a first driving-roller stand rotary drive for rotating drive rollers of the first driving-roller stand and also connected to a regulating device, wherein the first driving-roller drive is connected to the regulating device to regulate the transport speed of the metal strip in the first driving-roller stand.

28. The plant of claim 22, further comprising:

a regulating device to regulate the transport speed of the metal strip in the first driving-roller stand; and a strip location device arranged between the two-roll casting device and the first driving-roller stand and operable to detect a position of the metal strip on the deflecting support device, wherein the strip location device is coupled to the first driving-roller stand via the regulating device.

29. The plant of claim 28, wherein the strip location device is further coupled to the two-roll casting device.

30. The plant of claim 22, wherein the rolling plant is arranged after the second driving-roller stand and is operable to reduce thickness of and transform the structure of the cast metal.

31. The plant of claim 30, further comprising working rolls in the rolling plant and at least one heating device operable to heat working rolls.

32. The plant of claim 31, wherein the at least one heating device is an induction-heating device or a gas burner operable to be advanced to the working rolls.

33. The plant of claim 22, wherein the rolling plant comprises a single rolling stand and is a four-high rolling stand.

34. The plant of claim 22, further comprising a temperature-setting device after the second driving-roller stand and before the rolling plant and operable to provide strip-edge heating.

35. The plant of claim 34, further comprising a second driving-roller stand drive motor coupled to the rolling plant drive by means of a regulating device, wherein the cast metal strip is held under tension in at least one of the temperature-setting device and the rolling plant.

36. The plant of claim 22, wherein the strip store is operable as the inertization chamber.

37. The plant of claim 36, wherein the inertization chamber is further operable as a temperature-compensating zone.

38. The plant of claim 22, further comprising a strip-cooling section positioned after the rolling plant and operable to control cooling of the cast metal strip.

39. The plant of claim 22, further comprising a cross-dividing device for cross cutting the strip and being arranged before the strip-winding device and between the first and second driving-roller stands, and operable to keep the rolled strip under tension during the cutting.

40. The plant of claim 39, further comprising a strip-trimming device arranged before the strip-winding device.

41. The plant of claim 22, further comprising:

a tundish upstream of the two-roll casting device; and a casting ladle upstream of the tundish, wherein the casting ladle is operable for melt preparation and the tundish is operable for melt transfer.

42. The plant of claim 41, wherein the casting ladle further comprising a ladle turret having an extension arm which is supported so as to pivot along a substantially vertical axis between a casting position and a ladle-changing position.

* * * * *